United States Patent [19]

Sugiyama

[11] Patent Number: 4,952,171

[45] Date of Patent: Aug. 28, 1990

[54] TERMINAL COVER

[75] Inventor: Takeshi Sugiyama, Himeji, Japan

[73] Assignee: Mitsubishi Denki Kabushiki Kaisha, Tokyo, Japan

[21] Appl. No.: 293,388

[22] Filed: Jan. 4, 1989

[30] Foreign Application Priority Data

Jan. 20, 1988 [JP] Japan ..... 63-6585[U]

[51] Int. Cl.[5] ..... H01R 13/52

[52] U.S. Cl. ..... 439/522; 174/138 F

[58] Field of Search ..... 439/135, 136, 137, 142, 439/148, 149, 150, 202, 519, 521, 522, 523; 174/138 F

[56] References Cited

U.S. PATENT DOCUMENTS 1,176,942 3/1916 Bliss ..... 439/522 X
3,884,725 5/1975 Schmidt ..... 439/522
3,928,079 12/1975 Jennings et al. ..... 439/522 X
3,980,374 9/1976 Fallot ..... 439/521 X
4,677,407 6/1987 Tanaka et al. ..... 335/202

FOREIGN PATENT DOCUMENTS 0108518 11/1983 European Pat. Off. ..... 439/521

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

A terminal cover for covering an electrical terminal assembly comprising a cover main body defining therein an interior space for containing therein the terminal assembly and a tubular member extending from the cover main body into the interior space and having an inner diameter substantially equal to the outer diameter of a terminal bolt. The terminal cover, when in use, is maintained in position by frictional engagerment of the tubular member with respect to the terminal bolt.

3 Claims, 1 Drawing Sheet

TERMINAL COVER

BACKGROUND OF THE INVENTION

This invention relates to a terminal cover and more particularly to a terminal cover for covering an electrical terminal assembly in which a terminal conductor is electrically and mechanically connected to a terminal bolt.

FIGS. 1 and 2 illustrate examples of the conventional terminal cover for covering and protecting an electrical terminal assembly of an electrical apparatus against entry of moisture and dust. In the illustrated examples, the electrical terminal assemblies covered by the terminal cover are those of an solenoid switch assembly of an engine starter for example.

In FIG. 1, an electrical terminal assembly 1 includes a threaded terminal bolt 2 extending from a terminal base 1*a*, a small-diameter washer 3 fitted to the terminal bolt 2, a spacer 3*a* mounted on the washer 3, and a large-diameter washer 4 mounted on the spacer 3*a*. A terminal washer 5 connected to an insulated terminal conductor 6 is placed over the large-diameter washer 4, and the terminal washer 5 is firmly mechanically and electrically connected to the terminal bolt 2 by a nut 7 thread engaged on the terminal bolt 2. A washer 7*a* is inserted between the nut 7 and the eye washer 5 connected to the conductor 6.

The electrical terminal assembly 1 of the above structure is covered by a terminal cover 8. The terminal cover 8 is made of a resilient material such as rubber or plastic and comprises a cover main body 8*a* defining an interior space 8*c* for containing therein the electrical terminal assembly 1. The cover main body 8*a* comprises a substantially cylindrical wall 8*d* open at one end 8*e* for receiving therethrough the terminal assembly 1 and closed at the other end by a top wall 8*f* and a tube 8*b* radially outwardly extending from the cylindrical wall 8*d* for receiving therein the terminal conductor 6. It is seen that an inturned flange 8*g* is provided at the open end of the cylindrical wall 8*d* of the cover main body 8.

When it is desired to put the conventional terminal cover 8 on the electrical terminal asembly 1, the tube 8*b* is first placed on the terminal conductor 6 with the eye washer 5 centrally positioned in the cylindrical wall 8*f* of the cover main body 8*a*. Then, the eye washer 5 is fit on the terminal bolt 2 and secured on the bolt 2 by the nut 7. Finally, the cover main body 8*a* is pushed toward the electrical terminal assembly 1 so that the in-turned flange 8*g* at the open end 8*e* of the cylindrical wall 8*f* elastically fits and engages against the lower edge of the larger washer 4. Thus, when the terminal cover 8 is fit on the terminal assembly 1, the inturned flange 8*g* maintains, in cooperation with the tube 8*b* fitted over the terminal conductor 6, the terminal cover 8 in place.

FIG. 2 illustrates another example of the conventional terminal cover, in which an electrical terminal assembly 21 comprises a cup-shaped washer 9 secured by a second nut 9*b* between a terminal base 21*a* and the terminal eye washer 5 of the conductor 6. The cup-shaped washer 9 is provided at its open end with an out-turned flange 9*a* which engages the in-turned flange 8*g* of the cylindrical wall 8*d* of the terminal cover 8.

With the above described arrangement of the conventional terminal cover arrangement, the large-diameter washer 4 together with the small-diameter washer 3 and the spacer 3*a* shown in FIG. 1 or the cup-shaped member 9 having the outwardly extending flange 9*a* mounted by the nut 9*b* shown in FIG. 2 is neccessary to provide a peripehral edge for catching the inwardly extending flange 8*g* of the cover 8. Therefore the number of the parts for the electrical terminal assembly is relatively large and the structure is complex.

Since the above-described components such as washers 3 and 4 and the spacer 3*a* shown in FIG. 1 and the cup-shaped washer 9 with out-turned flange 9*a* are required only for the purpose of holding the terminal cover 8 on the terminal assembly 1, the arrangement of the terminal assembly 1 or 21 must be changed according to whether or not the terminal assembly is required to be covered in accordance with the specification of the electrical device or the like. This makes the manufacture of the electrical device having a terminal assembly complicated.

Further, in order to snap-fit the in-turned flange 8*g* of the cover 8 onto the engaging peripheral edge of the large-diameter washer 4 or the out-turned flange 9*b* of the washer 9, the hollow cylindrical portion of the cover 8 must be manually twisted with a considerable force so that the open end 8*e* of the cover 8 is deformed to allow the in-turned flange 8*g* of the cover 8 pass over and engage the engaging peripheral edge of the washer 4 or the washer 9. This requires time and skill.

SUMMARY OF THE INVENTION

Accordingly, an object of the present invention is to provide a terminal cover free from the above-discussed problems.

Another object of the present invention is to provide a terminal cover simple in structure and easy to manufacture.

A further object of the present invention is to provide a terminal cover which requires no additional components needed only for use with the terminal cover on the part of the electrical terminal assembly.

Still another object of the present invention is to provide a terminal cover which can be easily put on the terminal.

With the above objects in view, the terminal cover of the present invention for covering an electrical terminal assembly including a terminal bolt and a terminal conductor comprises a cover main body defining an interior space for containing therein the electrical terminal assembly and a tubular member extending from the cover main body into the interior space and having an inner diameter substantially equal to the outer diameter of the terminal bolt. The terminal cover, when in use, is maintained in position relative to the electrical terminal assembly by frictional engagement between the tubular member and the terminal bolt. According to one embodiment of the invention, the interior space of the cover main body is defined by a substantially cylindrical wall open at one end for receiving therethrough the terminal assembly and closed at the other end by a top wall and by a tube for receiving therein the terminal conductor. The tubular member for engaging the bolt may be flexible and may integrally extend from the top wall.

BRIEF DESCRIPTION OF THE DRAWING

The present invention will become more readily apparent from the following detailed description of the preferred embodiment of the present invention taken in conjunction with the accompanying drawing, in which.

DESCRIPTION OF THE PREFERRED EMBODIMENT

Figure 3:
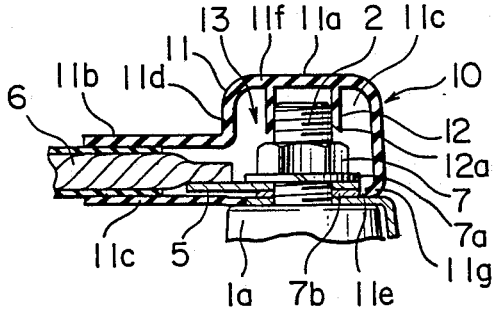
FIG. 3 is a cross-sectional view of a terminal cover of the present invention used in connection with a simple electrical terminal assembly.

FIG. 3 illustrates a terminal cover of the present invention for covering and protecting an electrical terminal assembly of electrical apparatus against entry of moisture and dust. In the illustrated embodiment, an electrical terminal assembly of a solenoid switch assembly of an engine starter is covered by the terminal cover of the present invention.

In FIG. 3, an electrical terminal assembly 13 includes a threaded terminal bolt 2 extending from a terminal base 1*a*, a washer 7*b* fitted to the terminal bolt 2. A terminal washer 5 connected to an insulated terminal conductor 6 is placed on the washer 7*b* and in turn a washer 7*a* is placed on the terminal washer 5. Then, the terminal washer 5 is firmly mechanically and electrically connected to the terminal bolt 2 by a nut 7 thread engaged on the terminal bolt 2. It is seen that the structure of the electrical terminal assembly 13 is simpler than those shown in FIGS. 1 and 2 in that there is no additional washers 3, 3*a* and 4 of FIG. 1 or the cup-shaped washer 9 of FIG. 2 in the terminal assembly 13 shown in FIG. 3.

The electrical terminal assembly 13 of the above structure is covered by a terminal cover 10 of the present invention. The terminal cover 10 is made of a resilient material such as rubber or plastic and comprises a cover main body 11*a* defining an interior space 11*c* for containing therein the electrical terminal assembly 13. The cover main body 11*a* comprises a substantially cylindrical wall 11*d* open at one end 11*e* for receiving therethrough the terminal assembly 13 and closed at the other end by a top wall 11*f* and a tube 11*b* radially outwardly extending from the cylindrical wall 11*d* for receiving therein the terminal conductor 6. It is seen that an in-turned flange 11*g* is provided at the open end of the cylindrical wall 11*d* of the cover main body 11.

According to the present invention, the terminal cover 10 also comprises a tubular member 12 extending downwardly from the top wall 11*f* of the cover main body 11 into the interior space 11*c*. The tubular member 12 is also made of rubber or plastic and has an inner diameter substantially equal to and preferably slightly smaller than the outer diameter of the terminal bolt 2. The tip 12*a* (the lower end in FIG. 3) of the tubular member 12 is bevelled for guiding the terminal bolt 2 for a easy insertion therein. The tubular member 12 may preferably be made integral with the cover main body 11*a* such as by molding.

When it is desired to put the terminal cover 10 of the present invention on the electrical terminal asembly 13, the radially extending tube 11*b* is first placed on the terminal conductor 6 with the eye washer 5 centrally positioned in the interior space 11*c* defined by the cylindrical wall 11*d* of the cover main body 11*a*. Then, the eye washer 5 is fitted on the terminal bolt 2 and secured on the bolt 2 by the nut 7 with the washers 7*a* and 7*b* suitably applied. Finally, the top wall 11*f* of the cover main body 11*a* is manually pushed toward the electrical terminal assembly 13 so that the inner surface of the tubular member 12 is fitted around the outer diameter of the threaded terminal bolt 2 as shown in FIG. 3, whereby the terminal cover 10 is maintained in position relative to the electrical terminal assembly 13 by frictional engagement between the tubular member 12 and the terminal bolt 2. It is seen that the in-turned flange 11*g* at the open end of the cylindrical wall 11*d* simply elastically touches the upper surface of the terminal base 1*a*.

Figure 1:
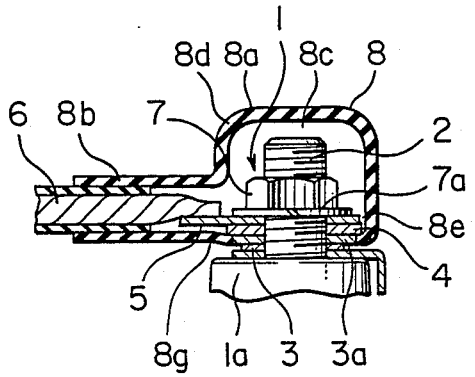
FIG. 1 PRIOR ART
FIG. 1 is a cross-sectional view of one example of the conventional terminal cover used in connection with an electrical terminal assembly.
Figure 2:
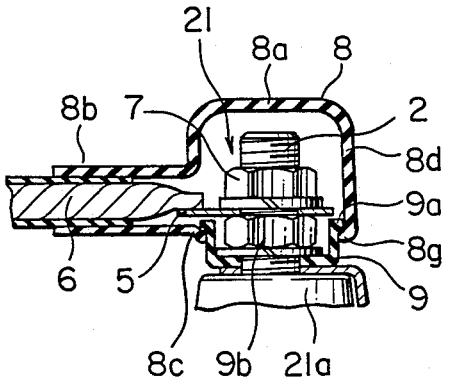
FIG. 2 PRIOR ART
FIG. 2 is a cross-sectional view of another example of the conventional terminal cover used in connection with a slightly modified terminal assembly.

As apparent from the foregoing description, any additional components for providing an engaging edge such as the washers 3, 4 and spacer 3*a* shown in FIG. 1 or the flanged cup-shaped member 9 shown in FIG. 2 are not required for holding the terminal cover 10 of the present invention on the terminal assembly 13. Therefore the number of the parts and the structural complexity of the electrical terminal assembly 13 are significantly decreased as compared to those of the conventional design. Also, since there is no need to change the structure of the terminal assembly in accordance with the need for the cover, the manufacture of the electrical device having a terminal assembly is simplified.

Further, in order to snap-fit the tubular member 12 onto the threaded terminal bolt 2, the cover main body 11 can be simply pushed toward the terminal bolt 2 without twisting it with a considerable force, so that placing the terminal cover 10 on the terminal assembly 13 is very simple.

What is claimed is:

1. A terminal cover for covering an electrical terminal assembly including a terminal bolt and a terminal conductor electrically connected to the terminal bolt, comprising:

a cover main body defining an interior space for containing therein said electrical terminal assembly; and a tubular member extending from said cover main body into said interior space and having an inner diameter substantially equal to the outer diameter of a threaded portion of said terminal bolt so as to be slidable over said threaded portion;

said terminal cover, when in use, being maintained in position relative to said electrical terminal assembly by frictional engagement of said tubular member with respect to said terminal bolt;

said cover main body defining said interior space comprising a substantially cylindrical wall open at one end for receiving therethrough said terminal assembly and closed at the other end by a top wall and a tube for receiving therein said terminal conductor, said tubular member extending from said top wall, and said open end of said cylindrical wall simply elastically touching an upper surface of a base of said electrical terminal assembly to thereby avoid the need for providing separate retaining elements for engaging said open end of said cover main body;

wherein said tubular member has an inwardly bevelled tip for guiding said terminal bolt during insertion in said tubular member.

2. A terminal cover as claimed in claim 1, further comprising an in-turned flange at said open end of said cylindrical wall of the cover main body.

3. A terminal cover as claimed in claim 1, wherein said cover main body and said tubular member are of an integral structure made of a resilient material.

* * * * *